United States Patent [19]

Okabe

[11] 4,054,089

[45] Oct. 18, 1977

[54] LINE PRINTER

[75] Inventor: Katsuhiko Okabe, Tokorozawa, Japan

[73] Assignee: Copal Company Limited, Tokyo, Japan

[21] Appl. No.: 643,381

[22] Filed: Dec. 22, 1975

[30] Foreign Application Priority Data

Dec. 27, 1974 Japan ..... 50-157265[U]
Dec. 27, 1974 Japan ..... 50-157268[U]

[51] Int. Cl.[2] ..... B41U 1/22
[52] U.S. Cl. ..... 101/99; 101/110
[58] Field of Search ..... 101/93.22, 93.24, 93.34, 101/93.41, 93.42, 95, 97, 99, 101, 106, 108, 110, 245, 359–362, 349

[56] References Cited

U.S. PATENT DOCUMENTS

| | | | |
|---|---|---|---|
| 2,351,612 | 6/1944 | Hawley | 101/349 X |
| 2,870,702 | 1/1959 | Van Buskirk | 101/245 X |
| 3,422,754 | 1/1969 | Bakardjiev et al. | 101/99 X |
| 3,669,016 | 6/1972 | Kittel | 101/110 X |
| 3,690,249 | 9/1972 | Nihira et al. | 101/95 |
| 3,738,264 | 6/1973 | Sobottka et al. | 101/99 X |
| 3,807,301 | 4/1974 | Decker | 101/110 |
| 3,884,144 | 5/1975 | Shimodaira | 101/99 |
| 3,916,787 | 11/1975 | Roggensack | 101/93.41 |

*Primary Examiner*—Edward M. Coven

[57] ABSTRACT

A line printer having a plurality of printing rings having characters on the peripheries thereof and coaxially arranged adjacent to each other on a driving shaft rotated in one and the same direction during each printing cycle with springs connected between the respective printing rings and the driving shaft so that the respective printing rings can be yieldably driven by the driving shaft through the springs and a movable roller pad adapted to abut against the printing rings at the predetermined printing position so that the selected character each of the printing rings temporarily held at the printing position during the rotation of the driving shaft is simultaneously printed on a sheet of paper held between the printing rings and the roller pad. The outer end each of the springs is supported by a stopper member having an engaging portion and secured to the driving shaft for rotation therewith while the inner end of each of the springs is held by the respective printing ring so that the respective printing ring is resiliently urged by the spring so as to cause the engaging portion of the respective stopper member to abut against an arresting portion of the respective printing ring thereby positioning the respective printing ring at the predetermined angular position with respect to the driving shaft. Thus, the desired character of each of the printing operation rings for the printing can be selected and positioned at the printing position by temporarily arresting selectively the respective printing ring by arresting means during the rotation of the driving shaft against the action of the spring.

3 Claims, 8 Drawing Figures

LINE PRINTER

FIELD OF THE INVENTION

The present invention relates to a line printer and, more particularly, to a line printer having a plurality of independently rotatable printing rings for simultaneously printing a line of printing on a sheet of paper by the selected one of characters on each of the printing rings by temporarily arresting the printing rings for positioning the selected characters at the printing position at which the roller pad is abutted against the printing rings for the printing on the paper sheet held therebetween.

BACKGROUND

Heretofore, various line printers of the type described above have been developed. However, the prior art line printers in general utilize a plurality of printing rings coaxially arranged on a driving shaft adjacent to each other with a spring interposed between the respective printing ring and the driving shaft so that the respective printing rings are resiliently held by stopper means at the predetermined starting positions with respect to the driving shaft so as to be yieldably rotated therewith. Thus, the desired one of the characters on each of the printing rings is permitted to be temporarily held at the predetermined printing position by selectively stopping the respective printing rings by the operation of arresting means during the rotation of the driving shaft against the action of the springs so as to form a line of printing of the desired characters on a paper by the cooperation of pad means adapted to be abutted against the printing rings at the printing position during each printing cycle. In order to allow the relative rotation between the respective printing ring and the driving shaft in the prior art printers, an elongated arcuate hole is provided in each of the printing rings through which a pin secured to the driving shaft is movably passed so as to connect the spring between the respective printing ring and the driving shaft for resiliently rotating the former with the latter. Alternatively, friction plate means is provided between the driving shaft and the respective printing ring so as to allow the return of the latter to the initial starting position after it has been released from the temporary arresting of the same. Such a construction is very complicated and very expensive in manufacture while the strength and the accurate operation are deteriorated.

In the prior art line printer, it is difficult to uniformly apply ink to all the characters in each printing ring by using an ink roller, because the rotational angle of the respective printing ring is different from the time at which the printing rings commence rotation for the selection of characters to the time at which the printing rings are temporarily arrested to position selected character in each printing ring at the printing position so that the rotational angle of each printing ring for returning the same to the initial starting position is different.

The present invention aims at avoiding the above described disadvantages of the prior art line printers.

SUMMARY OF THE INVENTION

An object of the present invention is to provide a novel and useful line printer having a plurality of rotatable printing rings adapted to print a line of printing on a paper simultaneously, which avoids the disadvantages of the prior art line printers and which is compact and simple in construction while it insures accurate operation of the printing rings.

Another object is to provide a novel and useful line printer of the type described above which has an ink roller adapted to be pressed against the printing rings during the rotation thereof so that all the characters on the respective printing rings can be supplied with ink uniformly without fail.

DETAILED DESCRIPTION OF THE PREFERRED EMBODIMENTS

Figure 1:
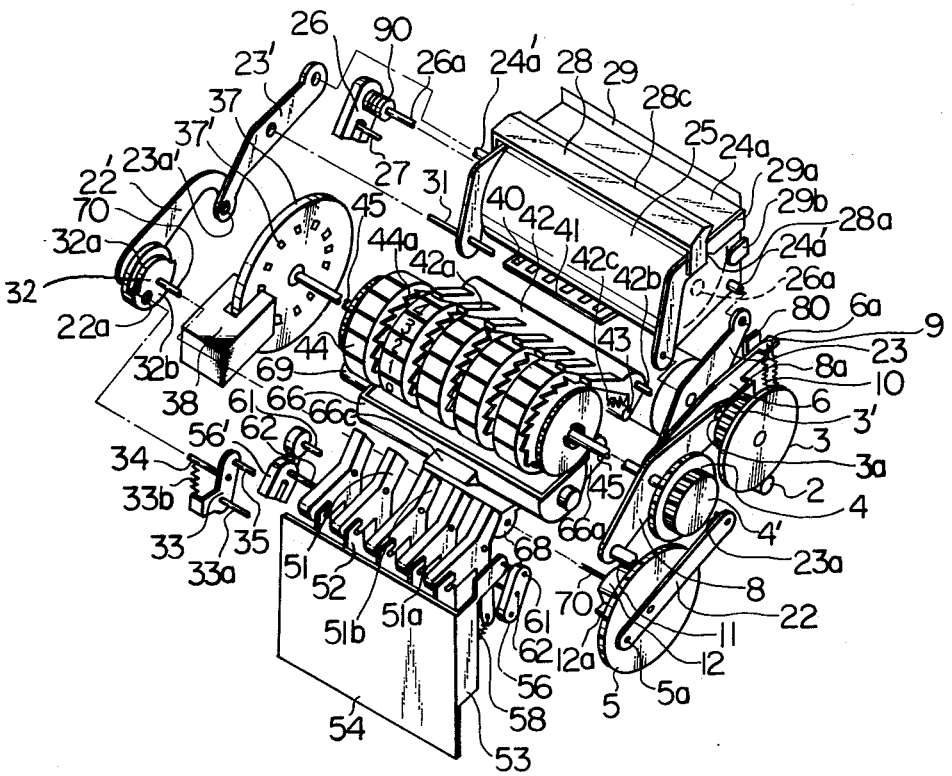
FIG. 1 is an exploded perspective view showing the general construction of an embodiment of the line printer constructed in accordance with the present invention.

FIG. 1 shows an embodiment of the line printer of the present invention.

The general correlated operations of the various elements of the printer will be described with reference to the drawings, particularly to FIG. 1.

Upon issuance of printing demand through a control circuit of the printer well known in the art, a driving motor (not shown) is driven so that a motor pulley 2 is rotated thereby. At the same time, a clutch magnet (not shown) is energized by the printing demand so that an armature thereof is attracted by the magnet thereby moving a pin integral with the armature. Thus, a lever 80 having an elongated hole slidably receiving the pin therein is swung so that a clutch lever 6 which has been arrested by the lever 80 is released thereby moving the clutch lever 6 and another clutch lever 8 having a bent portion 8*a* engaging with the lever 6 and urged thereagainst by a spring 10 tensioned between a bent portion 6*a* of the lever 6 and a bent portion of the lever 8 in the clockwise direction by the action of a spring 9 which is connected between the bent portion 6*a* and the shaft supporting the lever 80. By the clockwise movement of the lever 8, a reduction wheel 3 such as a rubber wheel rotatably supported by a shaft 3*a* integral with the lever 8 contacts the rotating motor pulley 2 thereby rotating the reduction wheel 3. A gear 3' integral with the wheel 3 meshes with a gear 4 secured to a printing ring driving shaft 45 rotatably supported by the printer frame. Thus, the gear 4 and the driving shaft 45 are rotated. A plurality of coaxially arranged printing rings 44 rotatably supported adjacent to each other on the driving shaft 45 and each resiliently arrested at a predetermined initial starting position with respect to the shaft 45 through a spring 83 for each printing ring 44 are also yiedably rotated together with the shaft 45. Each of the printing rings 44 bears on the periphery thereof a plurality of characters spaced from each other in the circumferential direction of the ring 44 thereby making ready for selection of desired character in each ring 44 to be arrested at a predetermined printing position for the printing operation in cooperation with a printing roller pad 25 to be described later.

A gear 5 secured to a cam shaft 70 rotatably supported by the printer frame is driven by a gear 4' integral with the gear 4. Thus, a cam 12 secured to the cam shaft 70 is also rotated so that the recessed portion 12*a* of the cam 12 which has been engaged with a pin 11 integral with the lever 8 is moved apart from the pin 11 and the pin 11 slidably contacts with the periphery of the cam 12 thereby permitting the reduction wheel 3 to be continuingly rotated by the motor pulley 2 even after the clutch magnet is deenergized.

The speed ratio between the printing ring driving shaft 45 and the cam shaft 70 is so determined by the gears 4' and 5 that the cam shaft 70 rotates one revolution as the driving shaft 45 rotates two revolutions, and select levers 51 are actuated within the first one revolution of the shaft 45 so as to selectively arrest the respective printing rings 44 for selection of the desired character in each ring 44 to be positioned at the printing position and, at the end of the first revolution of the shaft 45, i.e., at the end of a half revolution of the cam shaft 70, a printing roller pad supporting frame 24 pivoted by pins 24*a'* supported by the printing frame is swung toward the printing rings 44 through the linkage means 22, 23, 22', 23' operably connected between an eccentric pin 5*a* of the gear 5, an eccentric pin 22*a* of a cam 32 secured to the cam shaft 70 and a shaft 31 pivotally supporting the frame 24 so that a printing roller pad 25 rotatably supported in the frame 24 by a roller pad supporting shaft 26*a* integral with the pad 25 is abutted against the respective printing rings 44 at the printing position thereby permitting the selected characters of the rings 44 to be printed on a paper held between the rings 44 and the pad 25. Links 22, 23 are pivoted by a pin 23*a* while the links 22', 23' are pivoted by a pin 23*a'*.

As the cam shaft 70 continues to further rotate, i.e., after the commencement of the second revolution of the driving shaft 45, the frame 24 is returned to the initial position by the actuation of the linkage means 22, 23, 22', 23', and, during the return movement of the frame 24, the roller pad supporting shaft 26*a* is rotated a predetermined amount by means of one-way clutch spring 90 so that the pad 25 is also rotated so as to feed the paper by the cooperation of a comb-shaped plate spring 40.

Figure 4:
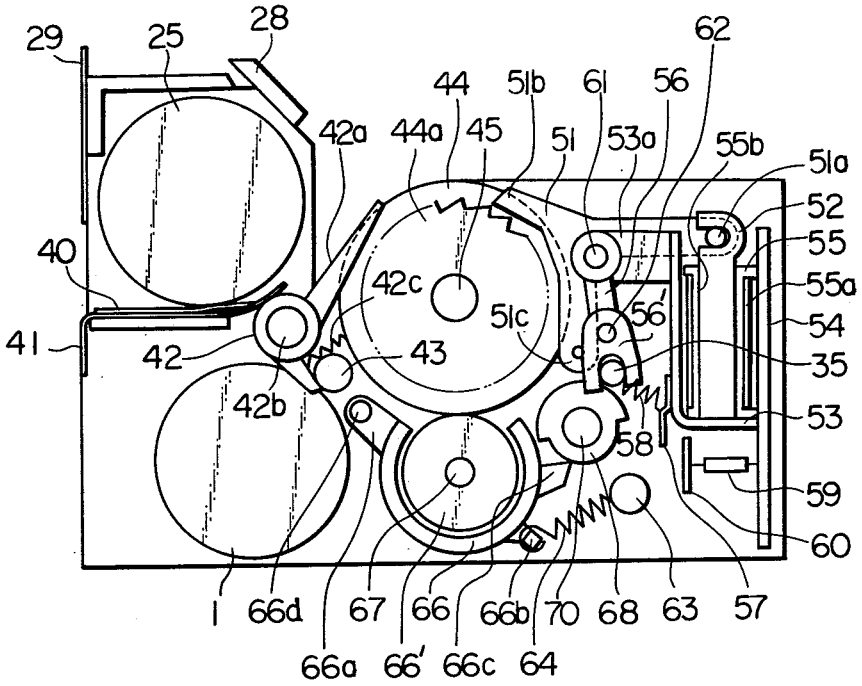
FIG. 4 is a side view showing the arrangement of the printing ring assembly, the select levers, the select magnets and the ink roller of the printer shown in FIG. 1.
Figure 5:
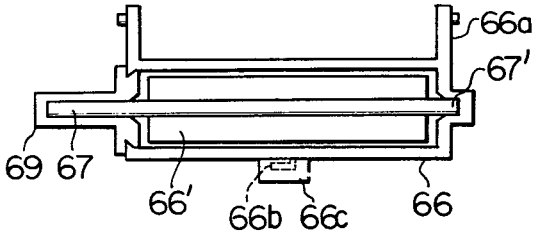
FIG. 5 is a sectional view showing the ink roller device incorporated in the printer of FIG. 1.
Figure 6:
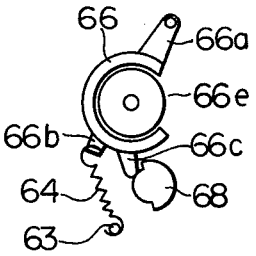
FIG. 6 is a side view of FIG. 5.
Figure 7:
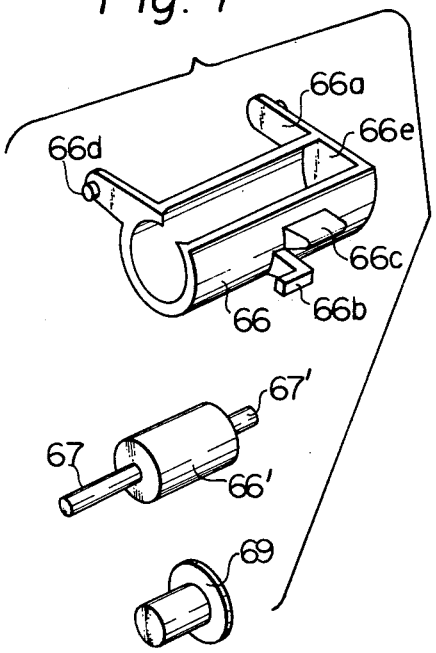
FIG. 7 is an exploded perspective view showing the construction of the ink roller device of FIG. 5.

An ink roller holder body 66 is swingably supported to the printer frame beneath the printing rings 44 by a pair of pins 66*d* provided on the end of each arm 66*a* integral with the body 66, and an ink roller 66' rotatably supported in the body 66 is adapted to be urged against the respective printing rings 44 through a cut-out portion 66*e* of the body 66 by the action of a spring 64 tensioned between the latching portion 66*b* of the body 66 and a pin 63 integral with the printer body so as to supply ink to the respective printing rings 44 during the rotation thereof, but the ink roller 66' is held apart from the printing rings 44 during the first revolution of the shaft 45 because a projection 66*c* provided on the body 66 engages with a cam 68 secured to the cam shaft 70 so that, when the projection 66*c* is engaged with the raised portion of the cam 68 during the first revolution of the shaft 45, i.e., during the first half revolution of the cam shaft 70, the body 66 is held swung in the clockwise direction (FIG. 4) so as to maintain the ink roller 66' spaced apart from the printing rings 44, whereas, when the projection 66*c* engages with the recessed portion of the cam 68 during the last half revolution of the cam shaft 70, i.e., during the second revolution of the printing ring driving shaft 45, the body 66 is swung in the counterclockwise direction by the action of the spring 64 so that the ink roller 66' is urged against the printing rings 44 to supply ink thereto.

As the cam shaft 70 is rotating during its first half revolution, a projection (not shown) of the link 23 is abutted against a pin formed on the clutch lever 6 so that it is urged upwardly against the action of the spring 9. At the same time, the lever 6 is arrested by the lever 80 which has been returned to the position ready for arresting the lever 6 by the deenergization of the clutch magnet and, at the end of one revolution of the cam shaft 70, the recessed portion 12*a* of the cam 12 engages again with the pin 11 of the clutch lever 8 so that the lever 8 is attracted upwardly toward the lever 6 by the action of the spring 10 thereby disengaging the reduction wheel 3 from the motor pulley 2 to stop the rotation of the driving shaft 45 and hence the rotation of the cam shaft 70 so as to complete one printing cycle to be ready for the next printing cycle upon issuance of the printing demand from the control circuit of the printer.

The select levers 51 for selectively arresting the respective printing rings 44 so as to position desired characters in the respective printing rings 44 at the printing position are swingably supported by a shaft 61 which is rotatably supported by a bracket 53*a* of a magnetic yoke 53 secured to a supporting plate 54. Select magnets 55 corresponding in number to that of the select levers 51 are mounted on the supporting plate 54 and operatively cooperate with the select levers 51 which in turn cooperate with the respective printing rings 44 for temporarily arresting the same so as to position selected characters at the printing position. To this end, an armature 52 is slidably housed in a hollow portion of each of the magnets 55 and the hooked portion each of the armatures 52 is engaged with a pin 51*a* secured to one arm of each of the levers 51. Each of the select levers 51 is normally urged in the clockwise direction (FIG. 1) by a spring 58 connected between lower arm 51*c* of the respective lever 51 and a stationary portion in the printer frame so that an arresting claw 51*b* each of the levers 51 is urged against a ratchet wheel 44*a* integral with the respective ring 44 so as to temporarily arrest the rotation of the respective ring 44 during the rotation of the driving shaft 45 when the claw 51*b* engages with one of the teeth of the ratchet wheel 44*a*. The positions of the teeth of the ratchet wheel 44*a* correspond to the respective characters in each printing ring 44 so that, when the ring 44 is temporarily arrested by the engagement of the claw 51*b* with the selected tooth of the ratchet wheel 44*a*, the desired character of the ring 44 is positioned at the printing position. However, the select magnets 55 are normally energized so as to attract the armatures 52 downwardly so that the select levers 51 are moved in the clockwise direction and held thereat by the engagement of the pins 51*a* with the hooked portions of the armatures 52 thereby maintaining the arresting claws 51*b* disengaged from the ratchet wheels 44*a*. Thus, when the select magnets 55 are selectively deenergized as the desired characters of the rings 44 are brought to the printing position during the first revolution each of the rings 44 upon issuance of the printing demand, the armatures 52 are selectively released and the respective select levers 51 are moved in the counterclockwise direction by the action of the springs 58 so as to selectively and temporarily arrest the rotation of the respective rings 44 while the driving shaft 45 continues its first revolution by virtue of the respective springs 83 being further energized by the relative rotation between the shaft 45 and the respective rings 44 thereby permitting desired character in each ring 44 to be temporarily held at the printing position.

A slit disc 37 (FIG. 1) is secured to the driving shaft 45 in order to generate synchronizing pulses for detecting the angular position each of the characters of the printing rings 44 before they are temporarily arrested. The disc 37 is formed with circumferentially spaced slits 37' the positions of which correspond to those of the characters of the rings 44 before they are arrested, and U-shaped optical detecting device 38 is provided in the printer in straddling relation to the disc 37. The detecting device 38 has a light source and an optical detecting element for receiving the light from the light source through the slits 37' so that a synchronizing pulse is generated each time the light is received by the detecting element through the respective slit 37' during the rotation of the shaft 45 so as to detect the position of the characters of the rings 44 for selection of the desired one thereof. The synchronizing pulses are supplied to the control circuit of the printer so as to serve to select the desired character for the printing.

In order to release the temporary arresting of the printing rings 44 so as to return them to the initial starting positions with respect to the driving shaft 45 by the action of the springs 83 after the printing operation, a select release lever 56 and a select release lever 56' are secured to the shaft 61 rotatably supported by the bracket 53 and swingably supporting thereon the select levers 51, and a shaft 62 is supported at the respective ends thereof by the levers 56, 56' so that when the levers 56, 56' are swung in the clockwise direction (FIG. 1) about the shaft 61, the shaft 62 is urged against the sides of the lower arms **51*c* of the select levers 51 thereby releasing the arresting of the ratchet wheels 44*a* by the claws 51*b* against the action of the springs 58. In order to release the claws 51*b* from the ratchet wheels 44*a* in accurate timing relation to the rotation of the driving shaft 45 as well as to the rotation of the cam shaft 70, a lever 33 (FIG. 1) is pivotally supported by a shaft 33*a* secured to the printer frame and urged in the clockwise direction by a spring 33*b* tensioned between a lower arm of the lever 33 and a stationary point in the printer frame. A pin 35 secured to the upper arm of the lever 33 slidably engages with the bifurcated portion of the select release lever 56' (FIG. 1) while a pin 34 secured to an intermediate portion of the upper arm of the lever 33 slidably engages with a recessed cam surface 32*a* and a raised cam surface 32*b* of the cam 32 secured to the cam shaft 70. The angular positions of the cam portions 32*a*, 32*b* with respect to the cam shaft 70 are so determined that the recessed cam portion 32*a* contacts with the pin 34 during the first half revolution of the cam shaft 70 caused by the actuation of the clutch levers 6, 8 upon issuance of the printing demand, i.e., during the first revolution of the printing ring driving shaft 35 within which the selection of the characters and arresting of the printing rings 44 followed by the printing operation by the roller pad 25 are effected, so that the lever 33 is swung in the clockwise direction and the select release lever 56' engaging with the pin 35 is swung in the counter clockwise direction thereby moving the shaft 62 apart from the lower arms 51*c* of the select levers 51 so as to permit the engagement of the claws 51*b* of the select levers 51 with the ratchet wheels 44*a* by the deenergization of the select magnets 55 caused by the printing demand for arresting the printing rings 44, while the pin 34 contacts the raised cam portion 32*b* during the last half revolution of the cam shaft 70, i.e., during the second revolution of the driving shaft 45 within which the paper feeding and the application of ink to the printing rings 44 are effected, so that the select levers 51 are positively released from the select levers 51 by the engagement of the shaft 62 with the lower arms 51*c* of the select levers 51 caused by the clockwise swinging of the select release lever 56' engaging with the pin 35 of the lever 33 which is in turn swung in the counterclockwise direction by the engagement of the pin 34 with the raised cam portion 32*b* of the cam 32.**

Thus, the releasing of the select levers 51 are positively effected in timed relation to the rotation of the printing rings 44 and the actuation of the roller pad 25 and the paper feeding as well as to the actuation of the ink roller 66' by means of a common single cam shaft 70 mechanically coupled with the printing ring driving shaft 45.

The select magnets 55 are energized at the same time the motor is energized so that the claws **51*b* of the select levers 51 are moved apart from the ratchet wheels 44*a*.**

When the desired characters of the respective printing rings 44 are selected by the control circuit by the aid of the supply of the synchronizing pulses to the control circuit of the printer, the respective select magnets 55 are selectively deenergized so as to arrest the respective printing rings 44 as described earlier.

Comb-shaped lever **42*a* pivoted by a shaft 42*b* urged by a spring 42*c* so as to be spaced apart from the printing rings 44** serves to prevent printing of undesired portion in the paper other than the selected characters for the printing.

Now, characteristic features of the present invention will be described.

Figure 2:
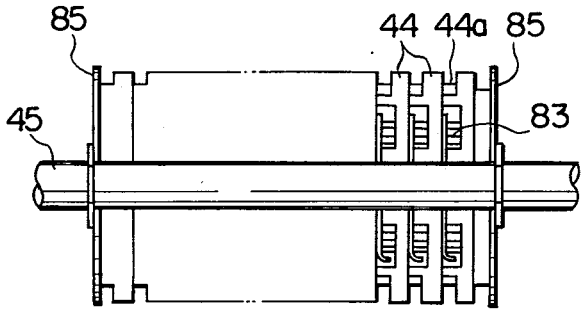
FIG. 2 is a side view showing the printing ring assembly shown in FIG. 1.
Figure 3:
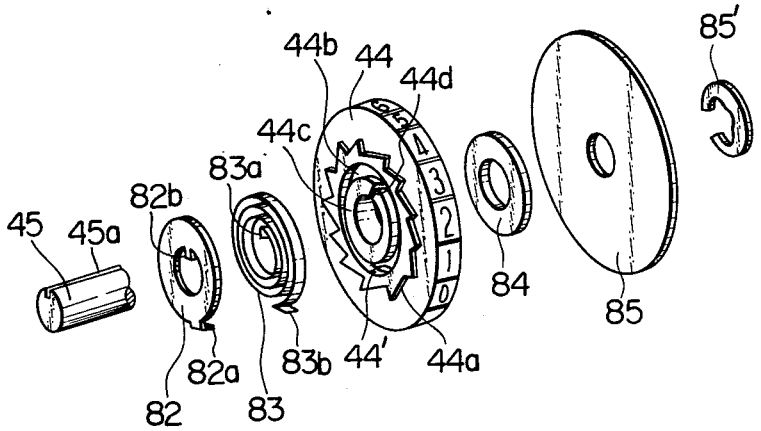
FIG. 3 is an exploded perspective view showing the construction of one of the printing rings and the elements cooperating therewith.

As shown in FIGS. 2 and 3, the printing rings 44 are rotatably supported on the driving shaft 45 adjacent to each other and each of the printing rings 44 has a ratchet wheel **44*a* integrally formed therewith. Each of the ratchet wheels 44*a* has ratchet teeth corresponding to the respective characters provided on the periphery of each printing ring 44. An annular recessed portion 44*b* is formed between the ratchet wheel 44*a* and a boss 44*c* of each printing ring 44 and the boss 44*c* is provided with an arresting cut-out portion 44*d*. The annular recessed portion 44*b* is formed with an arresting projection 44'. As shown in FIG. 3, a key way 45*a* is formed in the shaft 45 and stopper members 82 each belonging to the respective printing ring 44 are fitted on the shaft 45, and the stopper members 82 are rotated together with the shaft 45 by the engagement of lugs 82*b* formed in the members 82 with the key way 45*a*, while spring supporting portions 82*a* are formed in the respective members 82. The outer end of the spiral spring 83 received in the annular recessed portion 44*b* of each printing ring 44 is supported by the spring supporting portion 82*a* of each member 82 while the inner end of the spring 83 is fitted in the cut-out portion 44*d* so that the respective printing ring 44 is urged in the clockwise direction in FIG. 3 so that the respective ring 44 is resiliently arrested at the predetermined initial starting angular position with respect to the shaft 45 by the abutment of the portion 82***a* of the stopper member 82 against the projection 44'. A pair of engaging discs 85 having knurled portions at the periphery thereof are positioned at the opposite ends of the assembly of the printing rings 44 with washers 84 interposed therebetween, and the discs 85 are prevented from being detached from the shaft 45 by means of split washers 85' fitted on the shaft 45 so that the discs 85 are rotated together with the shaft 45.

The discs 85 serve to rotate the ink roller 66' synchronously with the printing rings 44 when the ink roller 66' is abutted against the printing rings 44 so as to prevent the relative shifting of the ink roller 66' with respect to the printing rings 44 for uniformly supplying ink to the latters as described later.

Thus, when the select levers 51 are selectively actuated by the deenergization of the respective select magnets 55 caused by the control circuit upon issuance of the printing demand as the driving shaft 45 is rotating so that the respective select levers 51 engage with the ratchet wheels 44*a,* the respective printing rings 44 are selectively and temporarily arrested against the action of the springs 83 while the driving shaft 45 is rotating so that the desired characters of the respective printing rings 44 are positioned at the printing position. After the printing operation, when the select levers 51 are released from the printing rings 44 by the actuation of the select release levers 56, 56', the printing rings 44 are rotated by the action of the springs 83 to return to the initial starting positions with respect to the driving shaft 45 at which the stopper members 82 are arrested by the projections 44' of the respective printing rings 44.

As described above, when the printing rings 44 are returned to their initial starting position after the printing operation, the spring supporting portion 82*a* abuts the projection 44'. Therefore, the spring 82 does not directly abut the arresting portion, thereby improving the durability while the accurate positioning of the printing rings at the initial starting position is insured and, since the printing rings 44 are rotated together with the driving shaft 45 the key way 45*a* of the shaft 45 engaging with the lug 82*b* can be made relatively wide, the machining can be made easy while accuracy is insured.

Referring now to FIGS. 1 and 5 – 7, the ink roller holder body 66 is swingably arranged beneath the printing rings 44 by the arms 66*a* and the body 66 is urged toward the printing rings 44 by the action of the spring 64 as described previously. The ink roller 66' is rotatably supported in the body 66 with one end 67' of the shaft 67 secured to the ink roller 66' rotatably fitting in the recess formed in the closed end of the body 66, while the other end of the shaft 67 is rotatably fitted in the hole formed in the cover 69 detachably mounted on the body 66. As shown in FIG. 15, the cover 69 is snugly attached to the body 66 by the inwardly projecting annular projection formed in the opened end of the body 66 and the annular groove formed in the cover 69.

By the action of the spring 64, the ink roller 66' is adapted to abut against the printing rings 44 through the cut-out portion 66*e* formed in the body 66 so as to supply ink to the printing rings 44. The projection 66*c* formed on the outer surface of the body 66 cooperates with the cam 68 secured to the cam shaft 70 as described earlier. The configuration of the cam 68 is so determined that the ink roller 66' is held apart from the printing rollers 44 during the first half revolution of the cam shaft 70, i.e., during the first revolution of the shaft 45 within which the selection of the characters and the printing operation have been effected, while, during the last half revolution of the cam shaft 70 in which the arresting of the printing rings 44 has been effected so as to return to their initial starting positions with respect to the shaft 45 and to rotate one revolution together with the shaft 45, the body 66 is swung toward the printing rings 44 to abut the ink roller 66' against the printing rings 44 by the action of the spring 64 so that ink is uniformly applied to the respective characters on each printing rings 44.

In order to insure uniform application of ink to the printing rings 44 from the ink roller 66', the engaging discs 85 of the printing ring assembly is adapted to contact with the ink roller 66' when the latter is urged against the printing rings 44 so that the ink roller 66' is rotated synchronously with the printing rings thereby preventing relative slip therebetween to insure positive and uniform application of ink to the printing rings 44.

Figure 8:
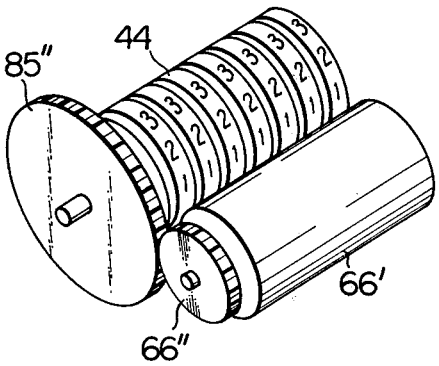
FIG. 8 is a perspective view showing a modification of the engaging means for synchronizing the rotation of the ink roller with those of the printing rings for uniformly supplying ink to the latters.

FIG. 8 shows a modification of the engaging means for synchronizing the rotation of the ink roller 66' with the printing rollers 44. In FIG. 8 the gear 85'' is secured to the shaft 45 instead of the discs 85 in FIG. 8 while the gear 66'' is secured to the ink roller shaft 26*a* which engages with the gear 85'' when the ink roller 66' is abutted against the printing rings 44 for supplying ink thereto. Thus, the ink roller 66' is rotated in synchronism with the printing rings 44 to insure uniform supply of ink to the respective characters on each printing ring 44.

In the above description a clutch mechanism is used for driving the driving shaft 45 and the cam shaft 70. However, the clutch mechanism may be dispensed with and the motor pulley 2 may be contacted at all times with the reduction wheel 3. In this case, a switch means is provided in cooperation with the gear and connected to the control circuit so that, each time the gear 5 is rotated one revolution, the motor is automatically deenergized to complete one printing cycle.

I claim:

1. In a line printer having a plurality of rotatable printing rings coaxially arranged adjacent to each other and each bearing on at least more than one-half of the peripheral surface thereof a plurality of characters spaced from each other in the circumferential direction of said rings, a driving shaft rotatably supporting said printing rings and resiliently holding them at predetermined positions relative thereto, said driving shaft having a starting position, one printing cycle being completed each time said driving shaft rotates two revolutions from said starting position, a movable roller pad adapted to abut against the respective printing rings at a predetermined printing position with respect to said printing rings thereby permitting one of the characters of each of said printing rings positioned at said printing position to be printed simultaneously on a sheet of paper held between said roller pad and said printing rings so as to form a line of printing on said sheet of paper, an ink roller for supplying ink to the respective characters on the periphery of each of said printing rings by abutment thereagainst after the printing has been completed, selectively arresting means for selectively arresting the respective printing rings independently from each other while said driving shaft rotates so as to temporarily hold a selected one of the characters of each of said printing rings stationarily at said printing position by shifting the positions of said printing rings relative to said driving shaft from said predetermined relative positions, said arresting means when released from said printing rings, permitting said printing rings to return to said predetermined positions relative to said driving shaft, the timing of operation of said selectively arresting means being controlled with respect to the operation of said roller pad so that a line of printing of selected characters is formed on said paper after the selection of characters has been completed and, thereafter, the respective printing rings are released from their selectively arrested positions so as to restore the rings to the initial positions with respect to said driving shaft and terminate one printing cycle, an improvement comprising stopper members arranged on said driving shaft so as to be rotated therewith and each cooperating with the respective printing ring, each of said stopper members including an engaging portion, ratchet teeth on each of said printing rings engageable by said arresting means for holding the printing rings in readiness for the printing operation, the positions of said ratchet teeth being selected to correspond respectively to the positions of the respective characters on each of said printing rings, arresting portions each formed in the respective printing rings so as to engage with the respective stopper member, spring means for each printing ring having one end supported by the respective printing ring and the other end supported by the respective stopper member cooperating with the corresponding printing ring for resiliently abutting said arresting portion in each of said printing rings against said engaging portion of each of said stopper members so as to resiliently maintain each of said printing rings at a predetermined angular position with respect to said driving shaft, thereby for permitting each of said printing rings to be automatically returned to said predetermined angular position with respect to said driving shaft by the release of said printing rings from their temporarily arrested positions after the completion of the printing operation, engaging means for driving said ink roller synchronously with said printing rings thereby positively preventing relative angular displacement of said printing rings from said predetermined angular position with respect to said driving shaft when said ink roller abuts against said printing rings and cam means rotating in coupled relation to said driving shaft and engageable with said ink roller for permitting said ink roller to be disengaged from said printing rings during the printing operation in each printing cycle effected in the first revolution of said driving shaft while permitting said ink roller to contact said printing rings during the second revolution of said driving shaft.

2. In a line printer according to claim 1 wherein said engaging means comprises an engaging disc supported on said driving shaft so as to be rotated therewith, said disc having a periphery adapted to engage the periphery of said ink roller when the ink roller abuts against said printing rings so as to drive said ink roller in synchronism with said printing rings.

3. In a line printer according to claim 1 wherein said engaging means comprises a first gear supported on said driving shaft for rotation therewith and a second gear attached to said ink roller for rotation therewith to engage said first gear when said ink roller abuts against said printing ring so as to drive said ink roller in synchronism with said printing rings.

* * * * *